United States Patent [19]

Stehr

[11] Patent Number: 4,848,676

[45] Date of Patent: Jul. 18, 1989

[54] MEANS OF REGULATING AN AGITATOR MILL

[75] Inventor: Norbert Stehr, Mannheim, Fed. Rep. of Germany

[73] Assignee: Draiswerke GmbH, Mannheim, Fed. Rep. of Germany

[21] Appl. No.: 244,809

[22] Filed: Sep. 15, 1988

Related U.S. Application Data

[63] Continuation-in-part of Ser. No. 45,039, May 1, 1987.

[30] Foreign Application Priority Data

May 2, 1986 [DE] Fed. Rep. of Germany ..... 3614980
May 1, 1987 [WO] PCT Int'l Appl. ..... 045039

[51] Int. Cl.[4] ..... B02C 17/16; B02C 25/00

[52] U.S. Cl. ..... 241/33; 241/34; 241/36; 241/65; 241/171; 241/172

[58] Field of Search ..... 241/30, 33, 34, 35, 241/36, 65, 66, 67, 46 R, 46.11, 46.17, 171, 172, 173

[56] References Cited

U.S. PATENT DOCUMENTS 4,129,261 12/1978 Engels et al. .

FOREIGN PATENT DOCUMENTS 0109157 5/1984 European Pat. Off. .
2051003 10/1972 Fed. Rep. of Germany .
2932783 3/1980 Fed. Rep. of Germany .
3245825 6/1984 Fed. Rep. of Germany .

OTHER PUBLICATIONS

Article, *Aufbereitungs-Technik*, No. 10/1983, "Process Technological Investigations on a Stirred Ball Mill", Dr. Ing. N. Stehr und Prof. Dr. Ing. J. Schwedes, Braunschweig.
Reprint from *German Chemical Engineering*, Edition 6, 1983.

*Primary Examiner*—Joseph M. Gorski
*Attorney, Agent, or Firm*—Browdy and Neimark

[57] ABSTRACT

An apparatus for regulating an agitator mill for comminution, deagglomeration and dispersion of grinding stock present in the form of a suspension is provided. To attain a constantly uniform grinding stock fineness, a device is provided for keeping the specific energy input constant, the specific energy input being determined by the quotient of the power introduced into the grinding stock and the grinding stock mass flow. A device is also provided for detecting the distribution of the auxiliary grinding bodies in the grinding chamber. The distribution of the auxiliary grinding bodies can be determined by detecting the pressure drop in the grinding chamber. Further, the distribution of the auxiliary grinding bodies can be detected by means of at least two partial cooling chambers connected parallel to one another, with individual heat flows being detected via the partial cooling chambers.

28 Claims, 6 Drawing Sheets

MEANS OF REGULATING AN AGITATOR MILL

The present application is a continuation-in-part application of the prior application Ser. No. 045,039, filed on May 1, 1987, entitled MEANS OF REGULATING AN AGITATOR MILL.

BACKGROUND OF THE INVENTION

In the publications by Stehr and Schwedes in German Chemical Engineering 6 (1983), pages 337–343 entitled "Investigation of the Grinding Behavior of a Stirred Ball Mill" and in AUFBEREITUNGS-TECHNIK [Processing Technology] Number 10/1983, pages 597–604 entitled "Verfahrenstechnische Untersuchung an einer Ruehrwerkskugelmuehle" [same title as above, in translation], the finding, obtained empirically, is discussed that an estimation of a theoretically expected comminution output, represented by a mean particle size, can be made with only one datum, namely the numerical value of the specific energy supply. At a desired fineness of the grinding stock, the required specific energy input can be given. It has been found in practice that this finding alone is not yet enough to attain a constantly uniform fineness of the grinding stock over a wide range of agitator speed, fill extent of the grinding bodies, geometric embodiment of the grinding chamber, grinding stock viscosity, grinding stock throughput and the like.

From German Offenlegungsschrift 29 32 783, it is known to keep the temperature of the grinding stock at the grinding stock outlet of the agitator mill at approximately a constant value in order to maintain a constant, replicable quality of the grinding stock. To this end, on the one hand a regulating circuit for a cooling loop is provided, which operates as a function of the temperature in the grinding chamber. Additionally, a regulating circuit is provided that sets the current of the agitator motor back whenever the grinding stock temperature exceeds a certain value; the reduction of the motor current is effected by a corresponding regulation of the throughput of the grinding stock pump and/or by changing the volume of the auxiliary grinding bodies in the grinding chamber. No special provisions for keeping the grinding fineness constant are known from this publication.

From European patent application EP-OS 0 109 157, it is known to perform a regulation of the speed of the agitator mechanism in order to attain desired properties of the grinding stock emerging from the agitator mill, the speed regulation being supposed to be performed as a function of suitable parameters. For instance, the quantity of coolant is to be regulated as a function of the grinding stock temperature. Once again, no provisions for keeping the fineness of the grinding stock constant are known from this publication.

SUMMARY OF THE INVENTION

Taking into account the finding described in the Stehr and Schwedes publication, according to which grinding stock processed in an agitator mill has constantly uniform grinding stock fineness whenever the specific energy input is kept constant, it is the object of the invention to devise a means of regulation of an agitator mill in which a grinding stock fineness that remains constant is attained under virtually all operating conditions.

The invention is also directed to the further finding that keeping the specific energy input constant results in a uniformly constant grinding stock fineness during the grinding process only when the distribution of auxiliary grinding bodies in the grinding chamber is largely uniform. In is most general form, in other words, the invention provides a means of regulation by which on the one hand the specific energy input is kept constant and on the other hand the uniformity of the distribution of the auxiliary grinding bodies in the grinding chamber is assured. In order to adhere very precisely to the constancy of the specific energy input, the mass flow of the grinding stock is preferably measured directly; that is, preferably an otherwise typical indirect measurement by way of measuring the volumetric flow is not performed, but instead the mass flow, that is, the mass supplied to the grinding chamber per unit of time, is detected. Suitable measuring instruments for this purpose are available on the market.

The invention further provides an apparatus for detecting the distribution of the auxiliary grinding bodies over the grinding chamber, based on the finding that a concentration of auxiliary grinding bodies before the grinding stock inlet or before the separating device leads to an increase in the pressure drop in the grinding chamber.

The invention further provides an apparatus for detecting the distribution of the auxiliary grinding bodies in the grinding chamber, based on the finding that a disproportionately great concentration of the auxiliary grinding bodies before the grinding stock inlet or before the separating device leads to an increase of the output introduced in this region and substantially converted into heat, which is removed via an associated separate cooling loop. A comparison of at least two separate coolant loops, associated with the two end regions of the grinding chamber, or of the heat flows transmitted by them, therefore provides information as to the distribution of the auxiliary grinding bodies in the grinding chamber.

Instead of the above described possibilities, the distribution of the auxiliary grinding bodies in the grinding chamber can also be detected by a sonic analysis, since the frequency and the intensity of the sounds produced in the grinding chamber depend on the particular local concentration of the grinding bodies. Furthermore, the distribution of the auxiliary grinding bodies can be detected via X-ray or ultrasonic measuring methods, or by radioactive measuring methods.

The invention further discloses how disproportionately large concentrations of auxiliary grinding bodies at the two ends of the grinding chamber can be compensated.

The invention further discloses which regulating variable must be changed if a deviation from the predetermined constant value of the specific energy input into the grinding stock occurs. If it is no longer possible to keep the specific energy input constant, then a remedy is provided by the provisions of claim 11.

The use of the regulation means according to the invention is not restricted to vertical agitator mills; it can equally be used with horizontal agitator mills. In such mills, a disproportionately large concentration of auxiliary grinding bodies can also occur before the separating device; a disproportionately large concentration of auxiliary grinding bodies at the grinding stock inlet, however, is not possible there.

Further advantages and characteristics of the invention will become apparent from the ensuing description of exemplary embodiments taken in conjunction with the drawings.

DESCRIPTION OF THE PREFERRED EMBODIMENTS

Figure 1:
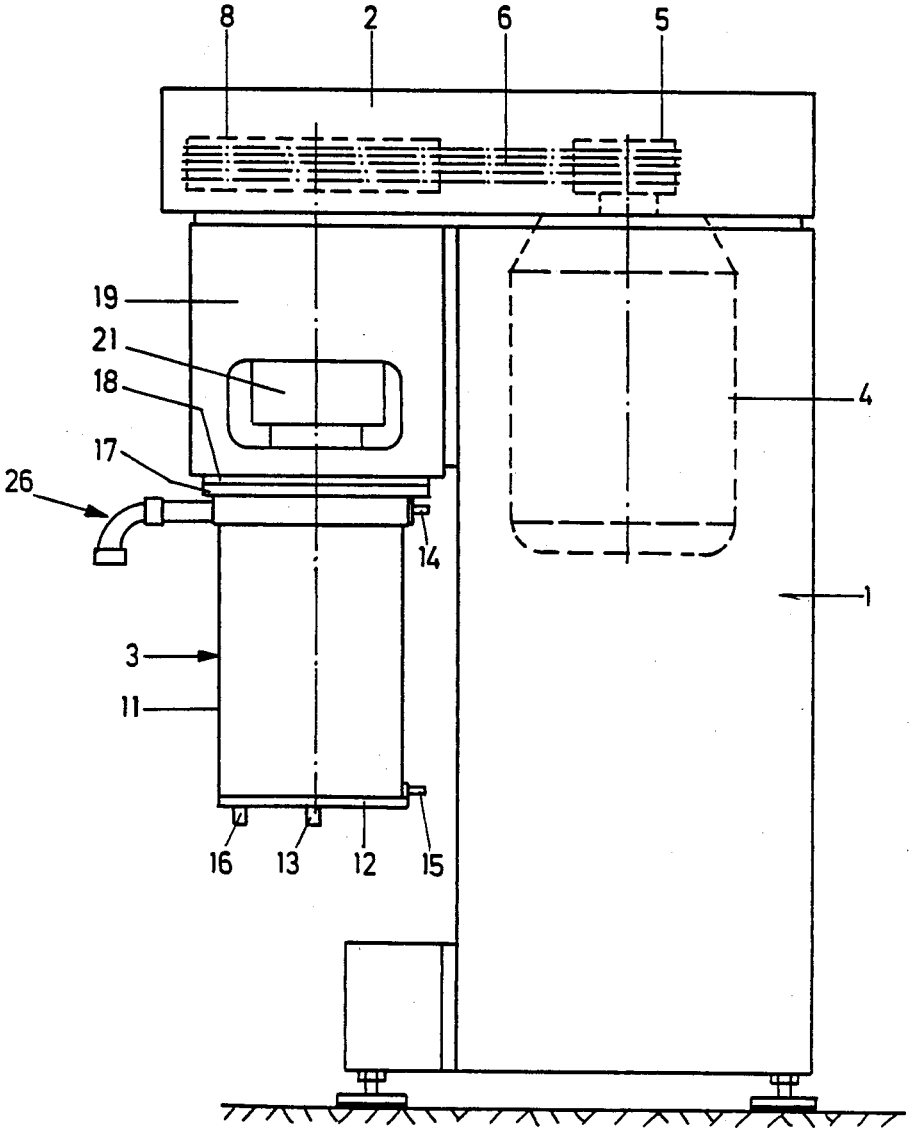
FIG. 1 is a view of an agitator mill.

The agitator mill shown in the drawing has a stand 1 in the typical fashion, on top of which a cantilevered support arm 2 is provided, on which in turn a cylindrical grinding container 3 is secured. An electric agitator motor 4 is accommodated in the stand 1 and is provided with a V-belt pulley 5, by which, via V-belt 6, a V-belt pulley 8 connected to be fixed against relative rotation to an agitator mechanism 7 is drivable for rotation.

The vertically disposed grinding container 3 comprises a cylindrical inner cylinder 10 surrounding a grinding chamber 9 and simultaneously forming the grinding container wall, which is surrounded by a likewise substantially cylindrical cooling jacket 11. The lower closure of the grinding chamber 9 and cooling jacket 11 is provided by a bottom plate 12, which is secured to the inner cylinder 10 and cooling jacket 11, for example by being screwed to them. A grinding stock feed pipe 13 is attached to the bottom plate 12, and grinding stock can be pumped through it from below into the grinding chamber 9. An upper coolant inlet pipe 14 and a lower coolant outlet pipe 15 are provided on the cooling jacket 11. Also provided in the bottom plate 12 is an outlet pipe 16 for auxiliary grinding bodies.

The grinding container 3 has an upper ring flange 17, by means of which it is secured on a cap 18 that closes the grinding chamber 9. This cap 18 is attached to the underside of a support housing 19, which is secured with its upper end to the support arm 2 of the agitator mill. An agitator shaft 20 that comprises a substantial portion of the agitator mechanism 7 is over-mounted in the usual manner in this support housing 19 in bearings 21, for instance as known from German Offenlegungsschrift 26 29 251 (corresponding to U.S. Pat. No. 4,129,261). The agitator shaft 20 extends in a sealed manner through the cap 18, again as known from the above-named publication. The agitator mechanism 7, in the manner known from this same publication, has disks 23 attached to the agitator shaft 20, and agitator bars 24 protrude radially from these disks 23 to serve as agitator tools. Counterpart bars 25 that are axially offset with respect to the agitator bars 24 are attached to the inner cylinder 10.

At the upper end of the grinding chamber 9, that is, at the end of the grinding chamber 9 opposite the grinding stock feed pipe 13, a grinding stock outlet pipe 26 is provided, which is preceded by a so-called annular gap separating device 27, by means of which the auxiliary grinding bodies 28 can be retained in the grinding chamber 9.

Figure 2:
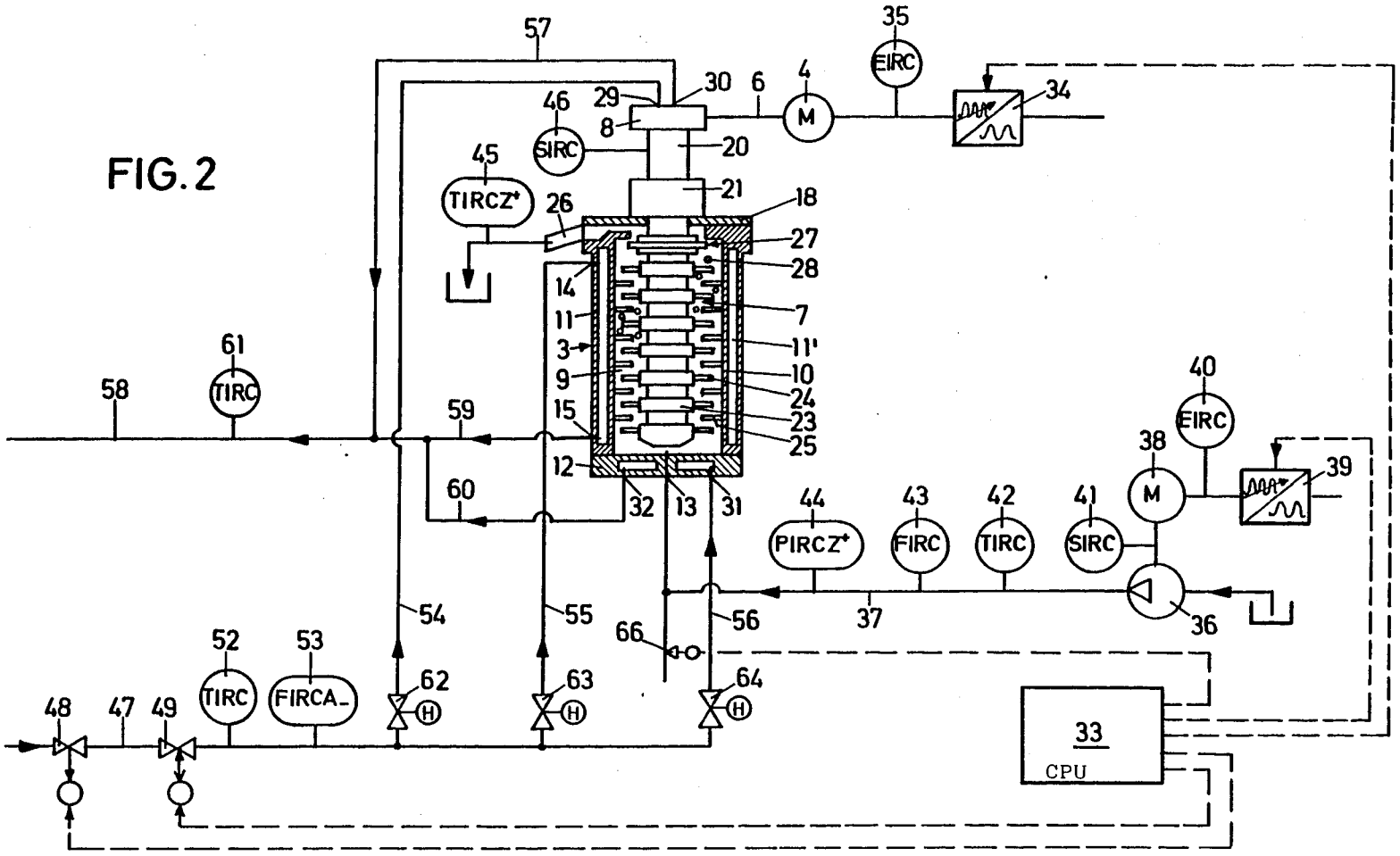
FIG. 2 shows a circuit layout for a means of regulating an agitator mill for a constant specific energy input and uniform distribution of the auxiliary grinding bodies via detection of the pressure drop in the grinding chamber.

A separating device 27 of this kind is also known from the above publication. As likewise known from the above publication, the agitator mechanism 7 is coolable. To this end, in a known manner, a coolant connection 29 and a coolant outlet 30 are provided on the end of the agitator shaft 20 oriented toward the V-belt pulley 8. As shown in FIG. 2, the bottom plate 2 can also be embodied as coolable, that is, hollow, and can be provided with a coolant inlet 31 and a coolant outlet 32.

The detailed structure of the agitator mill is of no significance for the invention; any kind of agitator tools can be used. The cap 18 can also be embodied as coolable. Similarly, the specific embodiment of the separating device is not important in this connection. The grinding chamber 9 is filled to an extent of 50–90% with auxiliary grinding bodies 28, which have a diameter on the order of 0.3 to 10 mm.

A first circuit diagram will now be explained, referring to FIG. 2.

Solid lines in the drawing as a rule indicate lines carrying liquid, while control lines that lead from a central computer 33 to various locations where a process controlled by the computer is to be triggered are shown in broken lines.

The supply of current to the agitator motor 4 is effected via a frequency converter 34 triggered by the computer 33, so that a sensitive speed control of the motor 4 and thus of the agitator mechanism 7 is possible. The power consumption of the agitator motor 4 is detected at a measuring location 35. In the drawings of the measuring locations, identifying letters are used, which have the following meaning for all the measuring locations to be mentioned:

- T, temperature (degrees C.)
- F, throughput (volume or mass per unit of time)
- S, speed (revolutions per unit of time)
- E, electrical power
- P, pressure
- I, indication
- R, recordation
- C, automatic continuous control (the detected variable is supplied to the computer)
- A−, alarm on reaching a lower threshold
- Z+, emergency intervention on reaching an upper threshold In the concrete case of the measuring location 35, the letters used there mean that the electrical power detected is displayed, recorded and supplied to the computer.

The grinding stock is fed in by means of a grinding stock pump 36 via a grinding stock inflow line 37 to the grinding stock feed pipe 13 of the grinding container 3. The pump 36 is driven by means of an electric pump motor 38, the supply of current to which is provided a frequency converter 39, so that the speed of the pump motor 38 and thus the feed output of the pump 36 is controllable very precisely. The frequency converter is also triggered by the computer 33. Associated with the pump motor 38 is a measuring location 40 for detecting the electric power consumed. A measuring location 41 is also associated with it for detecting the speed of the pump motor or pumping speed.

Also provided in the grinding stock inflow line 37 are a measuring location 42 for detecting the temperature of the material to be fed, a measuring location 43 for detecting the grinding stock mass flow pumped by the grinding stock pump, and a measuring location 44 for detecting the grinding stock pressure before or at the entrance to the grinding chamber 9.

Associated with the grinding stock outlet pipe 26 is a measuring location 45 for detecting the temperature of the emerging ground stock. The agitator shaft 20 has a measuring location 46 associated with it for detecting the speed of the agitator shaft 20.

The supply of coolant is effected via a central coolant line 47, in which a stop valve 48 that is triggerable by the computer 33 is provided, which is followed by a proportional valve 49, likewise controlled by the computer 33, the stopping behavior of which is therefore proportional to the extent of opening or closure. Such valves, available on the market, are thus particularly well suited for controlling the volumetric flow, in the present case in other words for controlling the flow of coolant.

Downstream of the valve 49 in the line 47 are a measuring location 52 for detecting the coolant forward-flow temperature and a measuring location 53 for detecting the volumetric flow of the coolant forward flow. The coolant flowing through the valve 49 and measuring locations 52, 53 is divided up into a plurality of coolant forward-flow branch lines 54, 55, 56. The branch line 54 leads to the coolant connection 29 of the agitator shaft 20; the branch line 55 leads to the coolant inlet pipe 14 of the cooling jacket 11; and the branch line 56 leads to the coolant inlet flow 31 of the bottom 12 of the grinding container 3. The returning coolant coming from the agitator shaft flows via a coolant return-flow partial line 57 to a coolant return-flow collecting line 58. One coolant return-flow partial line 59 leads from the coolant outlet pipe of the cooling jacket 11 and another coolant return-flow partial line 60 leads from the coolant outlet 32 of the bottom 12, both to the collecting line 58, in which a measuring location 61 is provided for detecting the coolant return-flow temperature. The division of the forward coolant flow to the three branch lines 54, 55, 56 is effected via manually adjustable valves 62, 63, 64 in these branch lines 54, 55, 56. Naturally, instead of these manually adjustable valves proportional valves triggered by the computer could also be provided, so that individual control of the partial coolant volumetric flows is possible.

A device 66, which is also triggerable by the computer 33, is provided for feeding auxiliary grinding bodies 28. Such devices are known, for instance from German Pat. No. 20 51 003. The feeding of auxiliary grinding bodies 28 by means of this device 66 is effected into the grinding stock inflow line 37, immediately before the grinding stock feed pipe 13.

Figure 3:
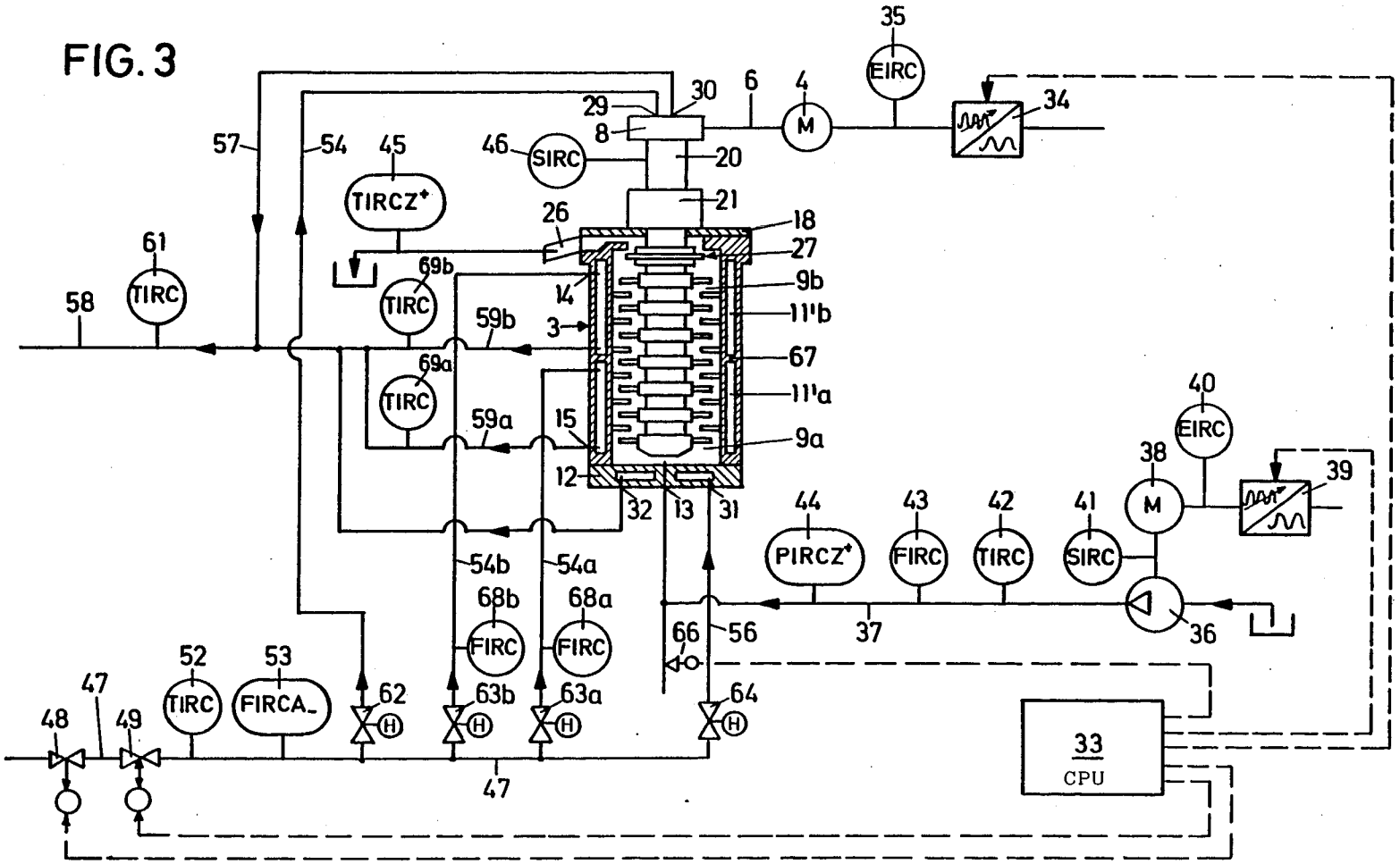
FIG. 3 shows a circuit layout for a means of regulating an agitator mill with a constant specific energy input and uniform distribution of the auxiliary grinding bodies in the grinding chamber via detection of the heat flows.

While in the exemplary embodiment of FIG. 2 a cooling chamber 11' is formed by the inner cylinder 10 and the cooling jacket 11 that extends substantially over the entire axial length of the grinding chamber 9, in the exemplary embodiment of FIG. 3 this cooling chamber is divided approximately in the axial middle by a partition 67, thus forming two partial cooling chambers **11'*a* and 11'*b*. One partial cooling chamber 11'*a* is associated with the partial grinding chamber 9*a*, which is connected to the grinding stock feed pipe 13. The other partial cooling chamber 11'*b* is associated with the partial grinding chamber 9*b*, which is located before the separating device 27, or in other words before the grinding stock outlet pipe 26. When identical elements are present in this exemplary embodiment, the same reference numerals are used as in FIG. 2**, so that they need not be described again here.

For supplying both partial cooling chambers **11'*a* and 11'*b*, corresponding coolant-forward flow branch lines 54*a* and 54*b* are provided, which branch off from the coolant forward-flow line 47. Manually adjustable valves 63*a* and 63*b* are again provided in both branch lines 54*a* and 54*b*. Once again, instead of the manually adjustable valves 63*a* and 63*b***, computer-controlled proportional valves can be provided.

From the partial cooling chambers **11'*a* and 11'*b*, cooling return-flow partial lines 59*a* and 59*b* lead to the coolant return-flow collecting line 58**.

Measuring locations **68*a* and 68*b* are located in both branch lines 54*a* and 54*b*, respectively, for measuring the volumetric coolant flow, that is, the quantity of coolant per unit of time in the respective branch line 54*a* or 54*b***.

Measuring locations **69*a* and 69*b* for measuring the temperature of the corresponding returning coolant are disposed in both coolant return-flow partial lines 59*a* and 59*b***.

With the additionally provided measuring locations, it is accordingly possible to detect the volumetric flow and outlet temperature of the coolant in both partial cooling chambers **11'*a* and 11'*b*, which are associated with the lower grinding chamber half 9*a* and the upper grinding chamber half 9*b*, respectively. The coolable bottom plate 12, having a corresponding coolant supply provided with measuring locations in the described manner, can also be associated with the lower grinding chamber half 9*a*, serving as a partial cooling chamber. The same applies to the upper grinding chamber half 9*b*, if the cap 18** is embodied as coolable is the manner already mentioned.

The mode of operation is as follows:

The basic precondition is that for a specific operative case the specific energy input into the grinding stock, that is, the quotient of the power introduced into the grinding stock by the agitator mechanism 7 and the mass flow of grinding stock, that is, the mass of grinding stock supplied to the grinding chamber 9 per unit of time, is to be kept constant, taking an allowable deviation into account. The value of the specific energy input for a particular specific grinding instance is ascertained empirically in the laboratory or engineering department under similar conditions on a reduced scale. For ascertaining such a value, an agitator mill of this kind should accordingly have a similarly embodied grinding container and a similarly embodied agitator mechanism, including similar agitator tools.

The regulating variables for the specific energy input are the power input into the grinding stock located in the grinding chamber 9, on the one hand, and the mass flow of grinding stock, on the other. The controlled variables for this purpose are again the power consumption of the agitator motor 4, specifically the operating power consumption minus an empirically ascertained idling power, to be stored in memory in the computer 33, of the motor 4 and agitator mill (without being filled with auxiliary grinding bodies).

Serving as the controlled variable for the power input into the process chamber is the speed or rpm of the agitator mechanism 7 and/or the degree of filling, that is, the degree to which the grinding chamber 9 is filled with auxiliary grinding bodies 28. The speed of the agitator mechanism 7 is set via the frequency divider 34. The grinding body fill degree is varied via the device 66 for feeding auxiliary grinding bodies 28, under the control of the computer 33.

A substantial higher-priority variable is the set-point temperature of the grinding stock at the outlet 26. If a maximum allowable grinding stock temperature is exceeded, damage to the grinding stock can occur. For example, desired color properties may be impaired, or dangerous solvent volatilization can occur, or chemical additives such as dispersing agents and stabilizers can be thermally decomposed. For this reason the regulation of the power consumption and/or of the grinding stock mass flow for keeping the mass-specific energy supply constant can be varied only taking into account a maximum allowable temperature of the grinding stock, which is detected at the measuring location 45. This maximum allowable temperature is above the set-point temperature by an allowable temperature deviation.

The control variable for regulating a constant grinding stock outlet temperature is the volumetric flow of the coolant. This variable is set in accordance with the grinding stock outlet temperature measured at the measuring location 45—triggered by the computer 33—by means of an adjustment of the proportional valve 49. The division into the individual branch lines 54, 55, 56 is effected via a manual basic setting of the valves 62, 63, 64. Once the valve 49 has already been opened completely, then a reduction of the grinding stock outlet temperature can be effected only by a reduction of the power input via the agitator mechanism 7, with a corresponding reduction of the grinding stock mass flow.

The speed of the agitator mechanism 7 can be regulated within a speed regulating range about the set-point rpm—in order to vary the power input into the grinding stock. This rpm regulating range is for instance in a range of 10% above or below the set-point rpm.

The actual rpm or speed of the agitator mechanism 7 is fed to the computer 33 from the measuring location 46.

The grinding stock mass flow is limited upwardly by a maximum power consumption and a maximum speed of the pump motor 38 and by a maximum allowable pressure. The power consumption is detected by the measuring location 40 and fed to the computer. Since the speed of the pump motor 38 or of the grinding stock pump 36 detected at the measuring location 41 provides only indirect information on the grinding stock mass flow, and because overly high counterpressure, air inclusions and other disturbances can impair the pumping of the grinding stock pump 36, the actual mass flow is detected at the measuring location 43 and supplied to the computer.

In the exemplary embodiment of FIG. 2, a uniform distribution of grinding bodies in the grinding chamber 9 is detected by means of detecting the grinding stock pressure at the measuring location 44 immediately before the grinding chamber. Since the grinding stock before the separating device 27 is subjected to atmospheric pressure, the grinding stock pressure detected at the measuring location 44 represents the pressure loss in the grinding chamber 9. A uniform distribution of the auxiliary grinding bodies 28 in the grinding chamber yields a set-point pressure of the grinding stock. If this set-point pressure is exceeded beyond an allowable deviation, this indicates that a disproportionately large concentration of grinding bodies has taken place either at the grinding stock inlet, that is, at the bottom of the grinding chamber 9, or in the vicinity of the grinding stock outlet before the separating device 27.

A uniform distribution of grinding bodies in the grinding chamber 9 exists if the forces engaging the auxiliary grinding bodies 28, namely the force of gravity, buoyancy and hydraulic flow forces, are in equilibrium. If gravity is predominant, then a disproportionately large concentration of grinding bodies takes place at the bottom of the grinding chamber. If the forces of buoyancy and hydraulic flow predominate, then an excessive concentration takes place before the separating device. In both cases, an increased pressure drop takes place in the grinding chamber; that is, the grinding stock pressure detected at the measuring location 44 increases. Furthermore, the power loss, which serves solely to stir the concentrated auxiliary grinding bodies 28 and is not converted into grinding output, increases; in other words, an excessive concentration of the auxiliary grinding bodies 28 in the vicinity of the grinding stock inlet or before the separating device 27 causes an increased heating of the grinding stock and results in greatly increased wear of the auxiliary grinding bodies 28, agitator tools and grinding chamber limiting walls.

Information on the question of whether the source of a pressure increase is a concentration of auxiliary grinding bodies 28 on the bottom of the grinding chamber 9 or before the separating device 27 can substantially be derived from the "history" of the pressure increase. If upon an increase in the grinding stock mass flow resulting from a corresponding increase in the speed of the grinding stock pump 36, the grinding stock pressure at the measuring location 44 rises, this is an indication that a disproportionately large concentration of auxiliary grinding bodies 28 before the separating device 27 has taken place, while a decrease in the pressure indicates that the auxiliary grinding bodies 28 have concentrated to a disproportionately great extent in the vicinity of the grinding stock inlet. In the latter case, by increasing the volumetric flow, the hydraulic flow forces acting upon the auxiliary grinding bodies 28 are increased, and the consequence is that the distribution is made uniform. Contrarily, if a disproportionately great concentration has taken place before the separating device 27, as explained above, then the grinding stock mass flow must be reduced.

The specific energy input through the agitator mechanism 7 into the grinding stock located in the grinding chamber 9 can no longer be kept constant if both determining variables have reached their respective extreme values. That is, if the grinding stock mass flow has already been regulated down to a minimum and the speed of the agitator mechanism 7 has been regulated upward to the maximum allowable value, then the refilling of the grinding chamber 9 with auxiliary grinding bodies 28 is initiated by the computer 33 via the device 66. At the same time, the speed is regulated downward.

In the exemplary embodiment shown in FIG. 3, the already mentioned heating of the grinding stock, which is dictated by additional power losses in the vicinity of an excessive concentration of auxiliary grinding bodies 28 is detected. To this end, the heating of the coolant in the partial cooling chamber 11'*a* and on the other hand in the partial cooling chamber 11'*b* is detected, specifically by detection of the coolant forward-flow temperature at the measuring location 52 and detection of the coolant return-flow temperatures at the measuring locations 69a and 69b. By simultaneous detection of the coolant volumetric flows at the measuring locations 68a and 68b, the heat consumed on the one hand in the partial cooling chamber 11a and on the other hand in the partial cooling chamber 11b is ascertained in a simple manner in the computer 33. The ratio of these figures to one another is directly a measure of whether an excessive concentration of auxiliary grinding bodies 28 has taken place either at the grinding stock inlet or before the separating device 27. If more heat is transmitted in the vicinity of the partial cooling chamber 11'a, then the excessive concentration is at the grinding stock inlet, while if there is greater heat transmission in the vicinity of the partial cooling chamber 11'b, the excessive concentration is before the separating device 27. Once again, the situation is remedied in the same manner as with the exemplary embodiment of FIG. 2.

Figure 4:
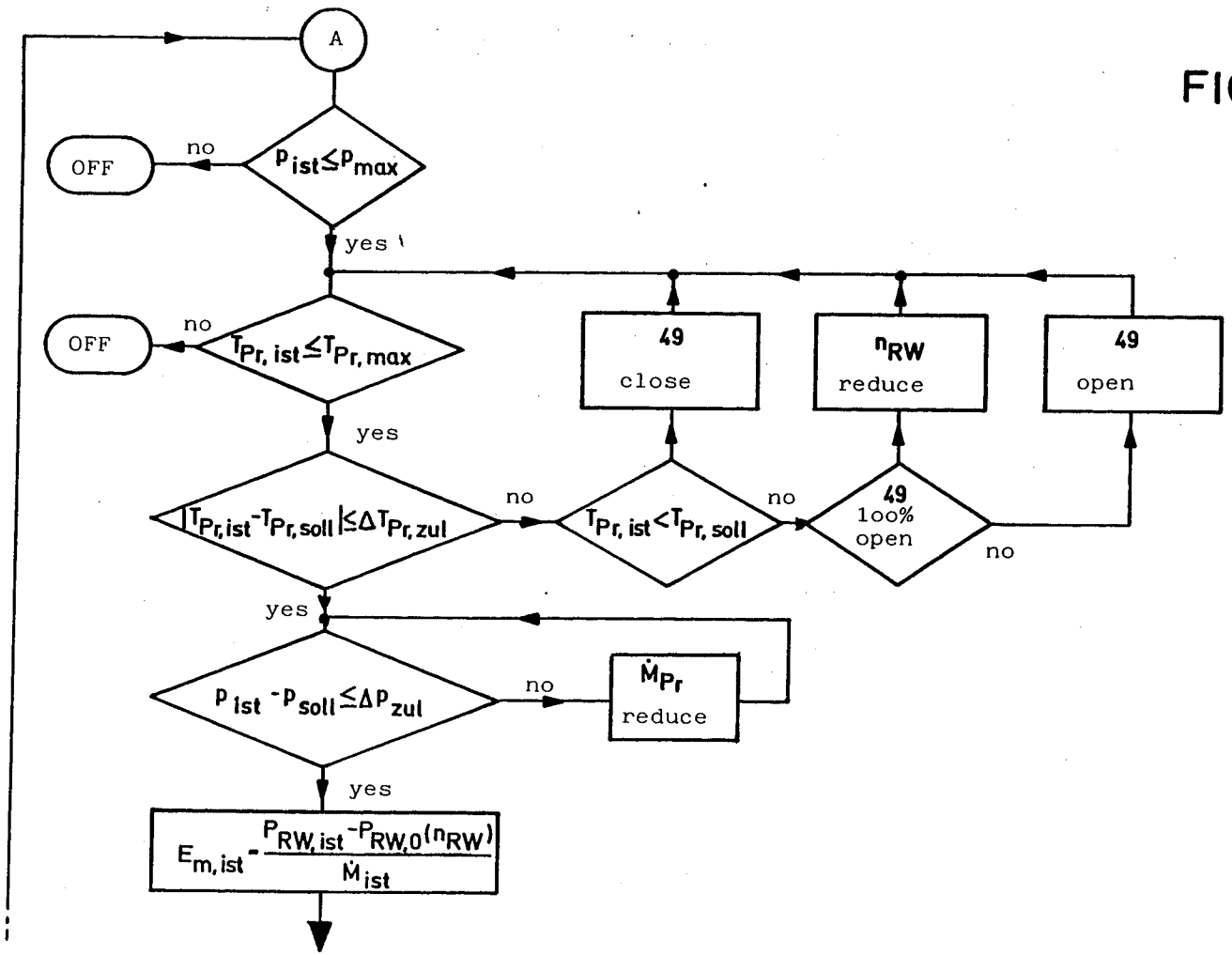
FIG. 4 is the first half of a flow chart for a regulating plan for the agitator mill of FIGS. 2 and 3.
Figure 5:
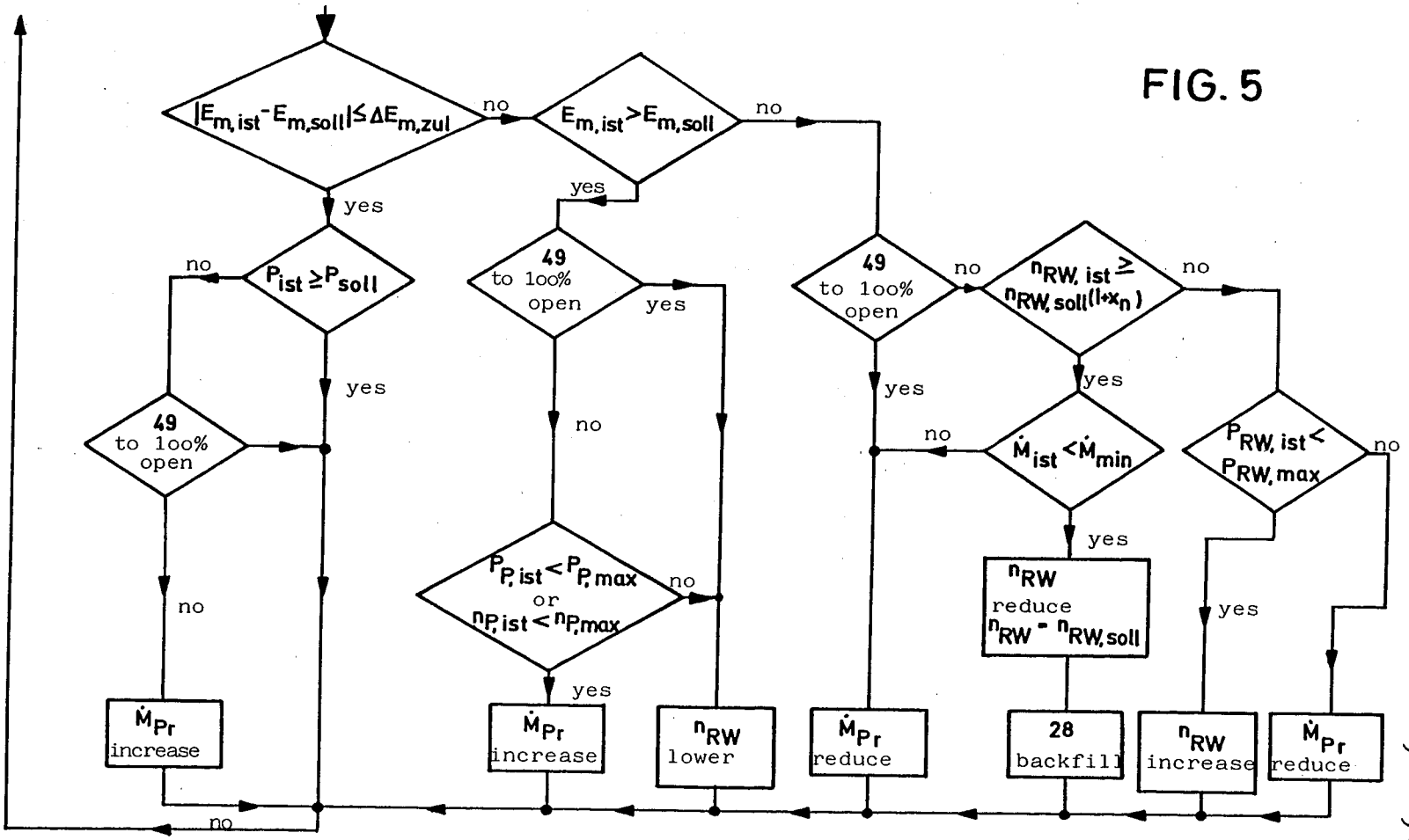
FIG. 5 is the second half of the flow chart for the regulating plan of the agitator mill of FIG. 2.
Figure 6:
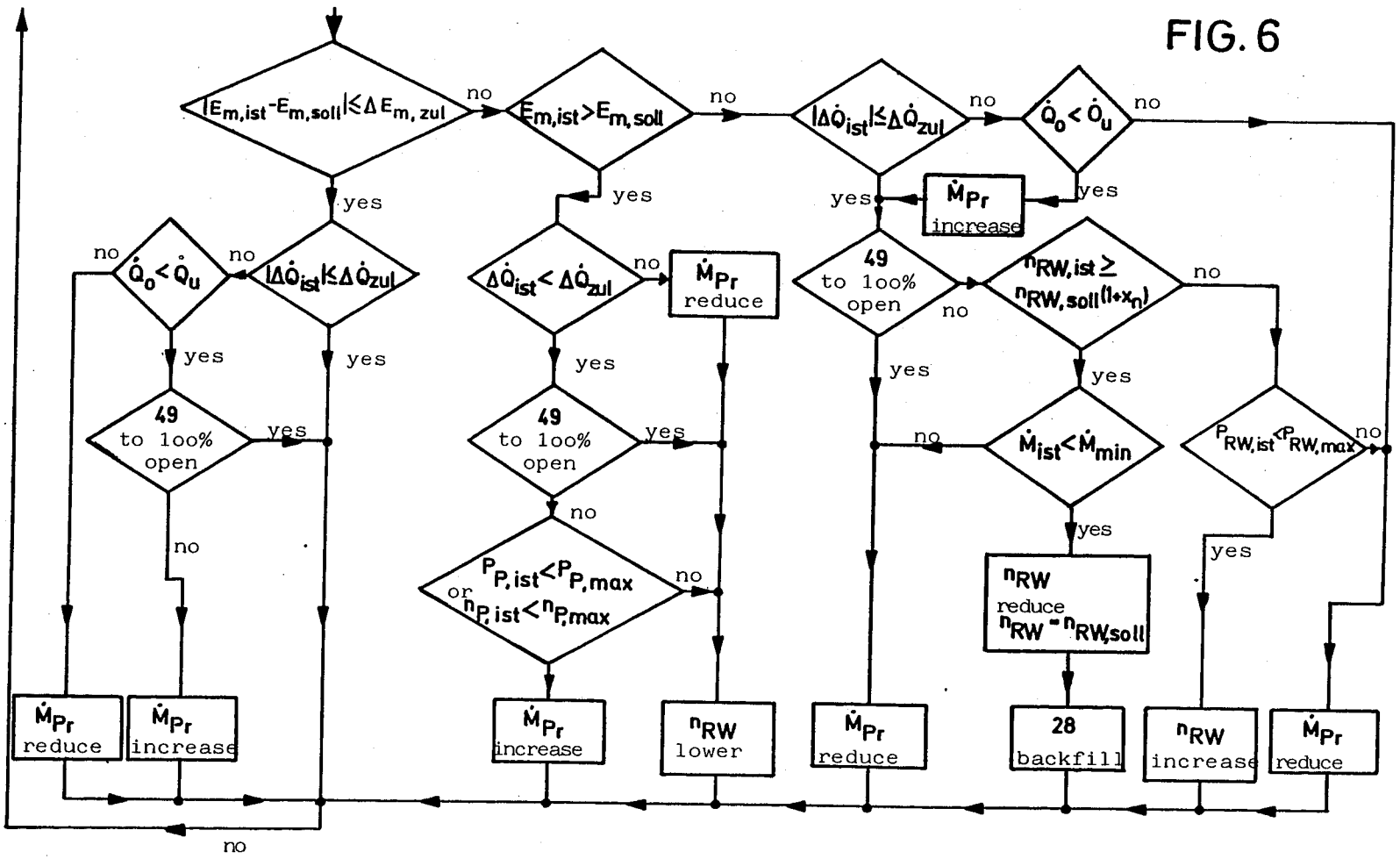
FIG. 6 is the second half of the flow chart for the regulating plan of the agitator mill of FIG. 3.

Based on the above general explanations, the flow charts in FIGS. 4, 5 and 4, 6 are self-explanatory. The flow chart of FIGS. 4, 5 shows the regulation of the grinding body distribution by way of detecting the grinding stock pressure before the grinding chamber, while the flow chart of FIGS. 4 and 6 shows the regulation of the grinding body distribution by detecting the heat flows Qu and Qo in the lower and upper portion 9a and 9b, respectively, of the grinding chamber 9. Otherwise, the regulating plans are identical. In accordance with the invention, they describe fully-automatic means of regulation.

In the flow charts, the symbols below have the following meanings:

T, temperature
$\dot{E}M$, mass-specific energy input
P, pressure
P, power
$\dot{M}$, grinding stock mass flow (mass per unit of time)
$\dot{Q}$, heat current (quantity of heat per unit of time)
n rpm
$\dot{V}$, volumetric flow (of the coolant)
The following subscripts are used:
Pr, product (ground stock)
ist, actual value
soll, set-point value
min, minimum value
max, maximum value
zul, allowable value
RW, agitator mechanism
P, pump
KW, coolant
o, assigned to the upper grinding chamber (before the separating device)
u, assigned to the lower partial grinding chamber (at the grinding stock inlet)

In the diamonds in FIGS. 4–6, the various comparative operations performed by the computer are shown, which are performed with the measured data furnished to the computer 33 by the various measuring locations. The arrows leading out of the various diamonds, with the words NO or YES indicating which operation is to be performed next, if the condition listed in a diamond has been satisfied or not. The provisions in rectangles indicate which controlled variable is varied by the computer, with suitable triggering of the associated control element, if one or more conditions (listed in the diamonds) are satisfied.

In individual cases, numerals are included in the rectangles. These are the reference numerals of the corresponding control element of FIG. 2 or 3.

Before grinding begins, the parameters listed below are fed into the computer 33; they relate to a specialized grinding operation with the corresponding conditions as follows:

| | |
|---|---|
| Rpm of the grinding mechanism: | $^{n}$RW, soll |
| Rpm regulating range: | $^{n}$soll (1 × $x_n$), where $x_n$ represent the rpm deviation of for example 10% |
| Idling power consumption: | $^{P}$RW, O($^{n}$RW) |
| mass throughput: | Starting value, $\dot{M}$start |
| Minimum mass throughput: | $\dot{M}$min |
| Specific energy input: | $^{E}$m, soll |
| Allowable deviation: | $\Delta^{E}$m, zul |
| Product temperature: | $^{T}$Pr, soll |
| Allowable deviation of the temperature: | $\Delta^{T}$Pr, zul |
| Pressure: | $^{p}$soll |
| Allowable pressure deviation: | $\Delta^{p}$zul |
| Maximum values: | |
| Pressure: | $^{p}$max |
| Product temperature: | $^{T}$Pr, max |
| Pump power consumption: | $^{P}$P, max |
| Agitator motor power consumption: | $^{P}$RW, max |
| Pump rpm: | $^{n}$P, max |

In the embodiment of FIG. 3 corresponding to the flow diagram of FIGS. 4 and 6, the allowable difference in the heat flows removed:

$$\dot{Q}_{zul}=\dot{Q}o-\dot{Q}u$$

is also fed to the computer for detection of the heat flows removed to the partial cooling chambers.

As FIG. 4 shows, after starting the pressure and the temperature are monitored in terms of the maximum allowable values, and if the maximum allowable values are reached an emergency shut-off is performed. Next, other temperature and pressure conditions are monitored and in the absence of any, the corresponding provisions described above are put into action. If the pressure and temperature of the grinding stock are within the range of the allowable deviation, then the actual specific energy input is monitored with respect to the allowable deviation. Depending on whether a deviation is present or not, the various further monitoring or other provisions included in FIGS. 5 and 6 are performed.

Whenever the program of the computer has been run though, it returns to the beginning and runs through a loop once again.

In addition or instead of measuring the pressure drop in the grinding chamber 9, 9a and 9b and measuring the temperature of the partial cooling chamber 11'a, 11'b it might be advantageous to detect a sudden increase of the power consumption of the agitator motor 4. Such a sudden substantial increase of power consumption indicates a concentration of the auxiliary grinding bodies in the vicinity of the separating device 27 or in the vicinity of the inlet 13. In the first case the grinding stock mass flow in reduced. In the second case the grinding stock mass flow is increased.

What is claimed is:

1. An agitator mill for comminution, deagglomeration and dispersion of grinding stock present in the form of a suspension, including a grinding chamber, in which an agitator mechanism drivable at a regulatable speed by an agitator motor is disposed, which grinding chamber is partly filled with auxiliary grinding bodies, into which chamber, at one end, a grinding stock inflow line coming from a grinding stock pump discharges, and which chamber is provided at its other end with a separating device for separating said grinding stock from said auxiliary grinding bodies and with a subsequent grinding stock outlet, means for detecting the power introduced into the grinding stock by the agitator mechanism, means for detecting the grinding stock mass specific rate of flow flowing through said grinding chamber, a cooling chamber surrounding the grinding chamber, an inlet pipe for coolant and an outlet pipe for coolant connected to said cooling chamber, control means for controlling the agitator mill to maintain specific energy input at a predetermined value, wherein said specific energy input is determined by the quotient of the power introduced into the grinding stock by said agitator motor and said grinding stock mass specific rate of flow, means for detecting distribution of the auxiliary grinding bodies in the grinding chamber; and control means for maintaining substantial uniform distribution of the auxiliary grinding bodies in the grinding chamber responsive to said means for detecting distribution, wherein said uniform distribution is defined as a uniform amount of the auxiliary grinding bodies per space unit throughout the grinding chamber.

2. The agitator mill as defined by claim 1, wherein said means for detecting the distribution of the auxiliary grinding bodies in the grinding chamber comprises a detecting means for detecting a non-uniform distribution of the auxiliary grinding bodies in the grinding chamber.

3. The agitator mill as defined by claim 2, wherein said means for detecting the distribution of the auxiliary grinding bodies in the grinding chamber comprises a measuring means for detecting pressure drop in the grinding chamber, means for generating a first signal indicating a greater concentration of said auxiliary grinding bodies in an area adjacent to the grinding stock inlet than in the remainder of the grinding chamber responsive to the pressure drop detected by said measuring means, means for generating a second signal indicating a greater concentration of said auxiliary grinding bodies in an area adjacent to the separating device than in the remainder of the grinding chamber responsive to the pressure drop detected by said measuring means, and means for generating a third signal when distribution of the auxiliary grinding bodies is substantially uniform throughout the grinding chamber responsive to the pressure drop detected by said measuring means.

4. The agitator mill as defined by claim 3, wherein said control means for controlling the agitator mill to maintain specific energy input at a predetermined value comprises control means responsive to said means for detecting distribution of the auxiliary grinding bodies in the grinding chamber for increasing the grinding stock mass specific rate of flow when said first signal is received.

5. The agitator mill as defined by claim 3, wherein said control means for controlling the agitator mill to maintain specific energy input at a predetermined value comprises control means responsive to said means for detecting distribution of the auxiliary grinding bodies in the grinding chamber for reducing the grinding stock mass specific rate of flow when said second signal is received.

6. The agitator mill as devined by claim 3, wherein a valve controllable as a function of the grinding stock temperature at the grinding stock outlet is disposed in at least one of the coolant flow lines.

7. The agitator mill as defined by claim 6, wherein said control means for controlling the agitator mill to maintain specific energy input at a predetermined value comprises control means responsive to said means for detecting distribution of the auxiliary grinding bodies in the grinding chamber for increasing the grinding stock mass specific rate of flow when the third signal is received, the predetermined value for the specific energy is exceeded and the coolant valve is only partly opened.

8. The agitator mill as defined by claim 6, wherein said control means for controlling the agitator mill to maintain specific energy input at a predetermined value comprises control means responsive to said means for detecting distribution of the auxiliary grinding bodies in the grinding chamber for lowering the speed of the agitator mechanism when the third signal is received, the predetermined value for the specific energy is exceeded and the coolant valve is completely opened.

9. The agitator mill as defined by claim 6, wherein said control means for controlling the agitator mill to maintain specific energy input at a predetermined value comprises control means responsive to said means for detecting distribution of the auxiliary grinding bodies in the grinding chamber for increasing the speed of the agitator mechanism when the third signal is received, the predetermined value for the specific energy fails to be attained and the coolant valve is partly opened.

10. The agitator mill as defined by claim 6, wherein said control means for controlling the agitator mill to maintain specific energy input at a predetermined value comprises control means responsive to said means for detecting distribution of the auxiliary grinding bodies in the grinding chamber for decreasing the grinding stock mass specific rate of flow when the third signal is received, the predetermined value for the specific energy fails to be attained and the coolant valve is completely opened.

11. The agitator mill as defined by claim 2, wherein said detecting means for detecting a non-uniform distribution of the auxiliary grinding bodies comprises:

said cooling chamber being provided such that the grinding chamber is surrounded by at least two partial cooling chambers connected in parallel to one another, a first of which is associated with the grinding stock inlet and a second with the separating device, and means for detecting rate of heat flow transmitted to each of the partial cooling chambers from said grinding chamber, said means for detecting distribution of grinding bodies within the grinding chamber being responsive to said heat flow detecting means, said distribution detecting means comprising generating means for generating a first signal indicating a greater concentration of said auxiliary grinding bodies in an area adjacent to the grinding stock inlet than in the remainder of the grinding chamber when the heat flow transmitted to the first partial cooling chamber is greater than the heat flow transmitted to the second partial cooling chamber, for generating a second signal indicating a greater concentration of said auxiliary grinding bodies in an area adjacent to the separating device than in the remainder of the grinding chamber when the heat flow transmitted to the second partial cooling chamber is greater than the heat flow transmitted to the first partial cooling chamber, and for generating a third signal when distribution of the auxiliary grinding bodies is substantially uniform throughout the grinding chamber.

12. The agitator mill as defined by claim 11, wherein said control means for controlling the agitator mill to maintain specific energy input at a predetermined value comprises control means responsive to said means for detecting distribution of the auxiliary grinding bodies in the grinding chamber for increasing the grinding stock mass specific rate of flow when said first signal is received.

13. The agitator mill as defined by claim 11, wherein said control means for controlling the agitator mill to maintain specific energy input at a predetermined value comprises control means responsive to said means for detecting distribution of the auxiliary grinding bodies in the grinding chamber for reducing the grinding stock mass specific rate of flow when said second signal is received.

14. The agitator mill as defined by claim 11, wherein a valve controllable as a function of the grinding stock temperature at the grinding stock outlet is disposed in at least one of the coolant flow lines.

15. The agitator mill as devined by claim 14, wherein said control means for controlling the agitator mill to maintain specific energy input at a predetermined value comprises control means responsive to said means for detecting distribution of the auxiliary grinding bodies in the grinding chamber for increasing the grinding stock mass specific rate of flow when the third signal is received, the predetermined value for the specific energy is exceeded and the coolant valve is only partly opened.

16. The agitator mill as defined by claim 14, wherein said control means for controlling the agitator mill to maintain specific energy input at a predetermined value comprises control means responsive to said means for detecting distribution of the auxiliary grinding bodies in the grinding chamber for lowering the speed of the agitator mechanism when the third signal is received, the predetermined value for the specific energy is exceeded and the coolant valve is completely opened.

17. The agitator mill as defined by claim 14, wherein said control means for controlling the agitator mill to maintain specific energy input at a predetermined value comprises control means responsive to said means for detecting distribution of the auxiliary grinding bodies in the grinding chamber for increasing the speed of the agitator mechanism when the third signal is received, the predetermined value for the specific energy fails to be attained and the coolant valve is partly opened.

18. The agitator mill as defined by claim 14, wherein said control means for controlling the agitator mill to maintain specific energy input at a predetermined value comprises control means responsive to said means for detecting distribution of the auxiliary grinding bodies in the grinding chamber for decreasing the grinding stock mass specific rate of flow when the third signal is received, the predetermined value for the specific energy fails to be attained and the coolant valve is completely opened.

19. The agitator mill as defined by claim 2, wherein said means for detecting the distribution of the auxiliary grinding bodies in the grinding chamber comprises the means for detecting the power introduced into the grinding stock by the agitator mechanism and means for generating a signal indicating a greater concentration of said auxiliary grinding bodies in an area adjacent to the separating device than in the remainder of the grinding chamber responsive to a substantial increase of said power.

20. The agitator mill as defined by claim 19, wherein said control means for controlling the agitator mill to maintain specific energy input at a predetermined value comprises control means responsive to said means for detecting distribution of the auxiliary grinding bodies in the grinding chamber for increasing the grinding stock mass specific rate of flow when said signal is received.

21. The agitator mill as defined by claim 1, wherein said control means for controlling the agitator mill to maintain specific energy input at a predetermined value comprises control means for providing that the grinding stock mass specific rate of flow is increased, if there is a concentration of said auxiliary grinding bodies in said grinding chamber in the vicinity of said grinding stock inlet, which concentration is substantially greater than that in the remainder of the grinding chamber.

22. The agitator mill as defined by claim 1, wherein said control means for controlling the agitator mill to maintain specific energy input at a predetermined value comprises control means for providing that the grinding stock mass specific rate of flow is reduced, if there is a concentration of said auxiliary grinding bodies in said grinding chamber in the vicinity of the separating device, which concentration is substantially greater than that in the remainder of the grinding chamber.

23. The agitator mill as defined by claim 1, wherein a valve controllable as a function of the grinding stock temperature at the grinding stock outlet is disposed in at least one of the coolant flow lines.

24. The agitator mill as defined by claim 23, wherein said control means for controlling the agitator mill to maintain specific energy input at a predetermined value comprises control means for providing that, in the event of uniform distribution of the auxiliary grinding bodies throughout the grinding chamber, if the predetermined value for the specific energy is exceeded and the coolant valve is only partly opened, the grinding stock mass specific rate of flow is increased.

25. The agitator mill as defined by claim 23, wherein said control means for controlling the agitator mill to maintain specific energy input at a predetermined value comprises control means for providing that, in the event of uniform distribution of the auxiliary grinding bodies throughout the grinding chamber, if the predetermined value for the specific energy is exceeded and if the coolant valve is completely opened, the speed of the agitator mechanism is lowered.

26. The agitator mill as defined by claim 23, wherein said control means for controlling the agitator mill to maintain specific energy input at a predetermined value comprises control means for providing that, in the event of uniform distribution of the auxiliary grinding bodies throughout the grinding chamber, if the predetermined value for the specific energy fails to be attained and the coolant valve is partly opened, the speed of the agitator mechanism is increased.

27. The agitator mill as defined by claim 23, wherein said control means for controlling the agitator mill to maintain specific energy input at a predetermined value comprises control means for providing that, in the event of uniform distribution of the auxiliary grinding bodies throughout the grinding chamber, if the predetermined value for the specific energy fails to be attained and if the coolant valve is completely opened, the grinding stock mass specific rate of flow is decreased.

28. The agitator mill as defined by claim 1, wherein means for feeding said auxiliary grinding bodies into the grinding chamber are provided, so that upon attaining a maximum allowable speed of the agitator mechanism and upon reduction of the grinding stock mass specific rate of flow to a predetermined minimum value, auxiliary grinding bodies are fed into the grinding chamber.

* * * * *